United States Patent [19]

Cerkovnik

[11] Patent Number: 5,025,873

[45] Date of Patent: Jun. 25, 1991

[54] SELF-RENEWING MULTI-ELEMENT CUTTING STRUCTURE FOR ROTARY DRAG BIT

[75] Inventor: Jerry Cerkovnik, Salt Lake City, Utah

[73] Assignee: Baker Hughes Incorporated, Houston, Tex.

[21] Appl. No.: 414,703

[22] Filed: Sep. 29, 1989

[51] Int. Cl.[5] ..... E21B 10/46

[52] U.S. Cl. ..... 175/329; 175/379; 175/410; 51/307

[58] Field of Search ..... 175/327, 329, 379, 385, 175/389, 408, 409, 410, 411, 373, 374, 424; 408/144, 145

[56] References Cited

U.S. PATENT DOCUMENTS

| | | | |
|---|---|---|---|
| 1,923,488 | 8/1933 | Howard et al. | 175/410 |
| 2,290,595 | 7/1942 | Kinnear | 175/379 |
| 2,966,949 | 1/1961 | Wepsala | 175/379 |
| 3,140,748 | 7/1964 | Engle et al. | 175/410 |
| 3,440,773 | 4/1969 | Hawkes . | |
| 3,768,581 | 10/1973 | Rederon | 175/329 |
| 4,073,354 | 2/1978 | Rowley et al. | 175/329 |
| 4,116,289 | 9/1978 | Feenstra | 175/329 |
| 4,150,728 | 4/1979 | Garner et al. | 175/374 |
| 4,190,126 | 2/1980 | Kabashima | 175/410 |
| 4,512,426 | 4/1985 | Bidegaray | 175/329 |
| 4,533,004 | 8/1985 | Ecer | 175/329 |
| 4,586,574 | 5/1986 | Grappendorf | 175/329 |
| 4,606,418 | 8/1986 | Thompson | 175/329 |
| 4,673,044 | 6/1987 | Bigelow et al. | 175/329 |
| 4,682,663 | 7/1987 | Daly et al. | 175/329 |
| 4,719,979 | 1/1988 | Jones | 175/329 |
| 4,726,718 | 2/1988 | Meskin et al. | 408/145 |
| 4,854,399 | 8/1989 | Zijsung | 175/61 |
| 4,913,247 | 4/1990 | Jones | 175/329 |

FOREIGN PATENT DOCUMENTS

| | | |
|---|---|---|
| 0086086 | 8/1983 | European Pat. Off. . |
| 2190412A | 11/1987 | United Kingdom . |

*Primary Examiner*—Stephen J. Novosad
*Attorney, Agent, or Firm*—Joseph A. Walkowski; Michael Polacek

[57] ABSTRACT

The present invention comprises a rotary drill bit including a cutting structure comprising an array of cutting elements oriented and arranged to facilitate concentration of the load on bit on groups of cutting elements until the elements become dulled or worn, at which point fresh cutting elements are exposed to engage the formation and tube the concentrated bit loading. Preferably, the cutting elements are configured and/or supported to break away from the cutting structure when worn to a certain extent, thereby facilitating exposure of fresh cutting elements to engage the formation.

28 Claims, 3 Drawing Sheets

SELF-RENEWING MULTI-ELEMENT CUTTING STRUCTURE FOR ROTARY DRAG BIT

BACKGROUND OF THE INVENTION

The present invention pertains to rotary drill bits, and particularly to fixed-cutter bits generally termed "drag bits" in the industry.

There are basically two types of cutting actions achievable with a fixed cutter on a rotating drag bit, the first being a shearing or scraping action, commonly generated by the use of a planar cutter having a circular or other arcuate profile on the part of the cutter contacting the formation, and a plowing or kerfing type action, commonly generated via the use of a polyhedron-shaped cutter oriented with a point or edge projecting above the face of the bit.

The planar cutters currently in use are generally formed of a planar layer polycrystalline diamond on a supporting substrate and are commonly called "PDC's", while the kerfing type of cutters are self supporting thermally stable polycrystalline diamond structures ("TSP's") in the shape of a disc or polyhedron. The former type of cutter must be affixed, as by brazing, to a tungsten carbide matrix type of drill bit after the bit is furnaced, since the PDC's are extremely degraded if not totally destroyed by the bit furnacing temperature employed. The latter type of cutter, TSP's, are so-called because they can survive the bit furnacing operation without degradation.

It has been proposed to simulate a large PDC type planar cutter utilizing a planar mosaic like array of TSP's, thereby permitting planar cutters to be furnaced into the bit in a single operation. Such cutters are disclosed in U.S. Pat. No. 4,726,718, assigned to the assignee of the present invention, the disclosure which is incorporated herein by this reference.

Large, planar TSP cutters similar to PDC's have recently become available on the market. While such cutters can be furnaced into a matrix-type bit, their cost is extremely high, and economics dictate sparing use thereof.

One problem confronting PDC cutters, individual TSP cutters, mosaic-type TSP cutters and the newly-introduced large planar TSP cutters, is the dulling of the cutters as the drill bit wears during drilling, causing the bit weight to be applied to an ever-increasing cutter area as the PDC or large TSP cutters flatten and the pointed TSP cutter points wear. The TSP "mosaic" planar array cutters suffer the same dulling problems as the PDC's.

There has been an appreciation in the industry that a cutter which is self-renewing would be desirable, but there has been no success in achieving such an end result.

SUMMARY OF THE INVENTION

In contrast to the prior art, the cutting structure of the present invention comprises a self renewing array of polyhedron-shaped cutters.

In the preferred embodiment of the invention, a plurality of polyhedral TSP's each having a planar, triangular end face are disposed in a plurality of rows, whereby a point of each TSP end face in the array is oriented in the same direction so as to provide a saw-tooth look. The TSP element rows are located one above another, may be offset from each other either laterally or in the direction of cutter travel, and the individual TSP elements of a particular row may be spaced or spread apart so that the points of the next lower row protrude upwardly therebetween.

The cutting structure described above will thus wear or dull only to a certain degree or level before the points of the next-lower row of TSP elements will begin to contact the formation. As cutting continues, the top row elements will break away from the cutting structure, leaving the next row of sharply pointed elements of the cutter array to engage the formation, substantially concentrating the load of the weight on bit on the small area of the points engaging the formation instead of the larger area of the worn top row of elements or, as in the prior art PDC cutters, the flattened cutter tops. Ideally, each row of elements in the array will break off of the array as they wear to a certain degree to permit the points of the next row of elements to engage the formation.

BRIEF DESCRIPTION OF THE DRAWINGS

The present invention will be more fully understood by those skilled in the art through a reading of the following detailed description of the preferred embodiments, taken in conjunction with the accompanying drawings, wherein.

DETAILED DESCRIPTION OF THE PREFERRED EMBODIMENTS

Figure 1:
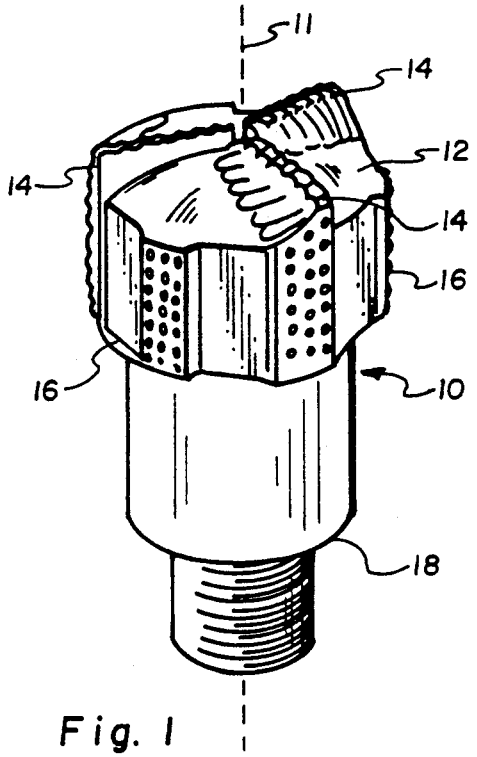
FIG. 1 is a perspective view of a bit incorporating a preferred embodiment of the cutting structure of the present invention.
Figure 2:
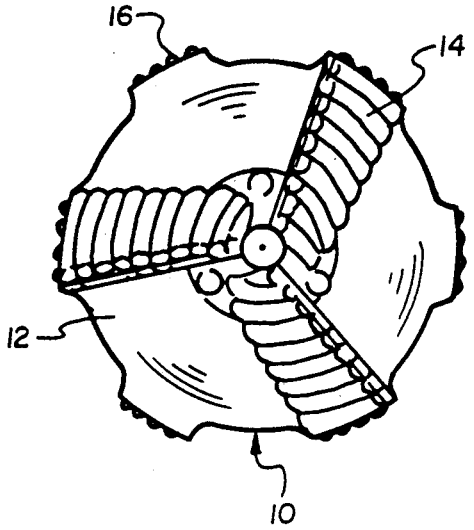
FIG. 2 is a perspective top view of the bit of FIG. 1.

Referring to FIGS. 1–4, an exemplary first preferred embodiment of a drill bit 10 incorporating the present invention will be described. Drill bit 10 includes a body section 12 which includes cutting structures indicated generally at 14, and gage pads, indicated generally at 16. Cutting structures 14 of this embodiment each constitute a single cutting blade in accordance with the present invention. Gage pads 16 do not normally serve a cutting function, except insofar as to maintain the gage (diameter) of the hole being bored by bit 10.

Bit body 12 is preferably at least partially a molded component fabricated through conventional metal infiltration technology, wherein a tungsten carbide powder is infiltrated with a copper-based alloy binder in a mold at elevated temperatures. However, the cutting structure of the present invention is not limited to matrix type infiltrated bits, as it also has utility and may be employed with a hard-faced cast steel body bit, the cutting structure of the present invention being formed on studs or other carrier members secured to the bit. Regardless of whether a cast-matrix or steel body bit is fabricated, a threaded shank 18 extends from the bottom of bit body 12 for securing bit 10 to a drill string.

Each cutting structure 14 of the embodiment of drill bit 10 extends from proximate the center line 11 of bit 10 to gage 16. Each blade like structure 14 is a mosaic-like array formed of a plurality of polyhedron-shaped thermally stable polycrystalline diamond product (TSP) elements 20 bonded into the tungsten carbide matrix of the bit body 12. Preferably, each TSP element has been coated, such as with a metal or metal alloy to facilitate bonding of the material to the matrix. An exemplary method and apparatus for coating TSP elements 20 is described in copending application Ser. No. 095,054, filed Sept. 15, 1987, now abandoned, in the names of Sung and Chen. The specification of application Ser. No. 095,054 is incorporated herein by reference for all purposes.

Figure 3:
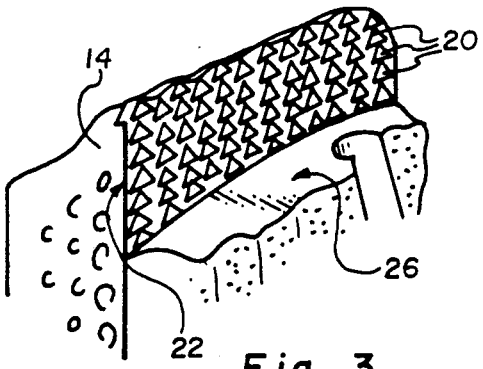
FIG. 3 is an enlarged perspective of the cutting structure of the bit of FIG. 1.
Figure 4:
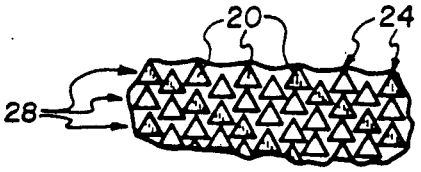
FIG. 4 is a front elevation of the cutting structure of FIG. 3.

As can be seen from FIGS. 3 and 4, each cutting structure 14 includes a generally planar cutting face 22 in which is embedded a plurality of the aforementioned TSP elements 20 with an exposed planar triangular face coplanar with the cutting face. Each TSP element 20 is rotationally oriented so that an apex 24 thereof is pointed away from the face 26 of bit body 12, and consequently toward the formation to be cut when the bit is employed at the end of a drill string. It can be seen in FIG. 3, but more clearly appreciated in FIG. 4, that the TSP elements 20 of this embodiment are aligned in offset rows 28, the TSP elements 20 of each row 28 being spaced apart a sufficient distance to permit the apices 24 of the TSP elements 20 next lower row 28 to extend upwardly therebetween. The degree of spacing and the protrusion of the apices 24 of each row 28 into the next higher row 28 is a matter of design choice. In FIG. 4, each row 28 vertically protrudes one-half of the height of a TSP element into the next row 28.

In operation, the TSP elements 20 of the outermost row 28 will engage a formation as the bit is rotated, and apices 24 of TSP elements 20 will cut the formation with a kerfing of plowing action. This will continue until the apices 24 are worn down and dulled, whereupon the apices 24 of the TSP elements 20 of next lower row 28 will begin to engage the formation, again substantially concentrating the weight on the rotating bit on a much smaller area to aggressively cut the formation instead of the bit "riding" on the formation as the element points dull.

Ideally, as each row 28 of TSP elements 20 dulls during cutting, it is desirable that they break away or are otherwise removed from the bit so as to concentrate the bit load totally on the newly-exposed sharp apices 24 of the next lower row 28 engaging the formation, so that only one row 28 of elements 20 is in substantial cutting engagement with the formation at any given time.

Figure 5A:
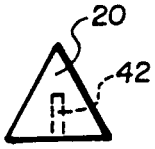
FIGS. 5A and 5B are front and side elevations of a particular TSP element configuration suitable for use with the cutting structure of the present invention.
Figure 5B:
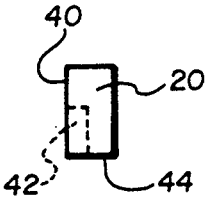
Figure 6B:
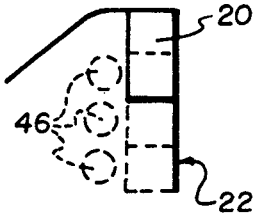
FIGS. 6A and 6B are side and front elevations of a modified TSP element support arrangement for use with the cutting structure of the present invention.
Figure 6A:
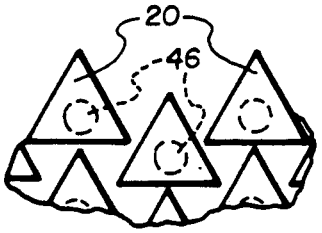

Such removal may be effected in several ways. For example, as shown in FIGS. 5A and 5B, the trailing face 40 of each TSP element 20 may include a vertical groove 42 therein extending from the base 44 of the element to a point near the geometric center of the element. When the element 20 wears to the point where the groove begins, the element groove will induce fracture from impact with the formation and break off from the bit. Alternatively, voids or an element of readily erodable material 46 may be placed in the cutting structure behind each element as shown in FIG. 6, the exposure of a void or erodable material as an element 20 wears, resulting in rapid erosion and loss of impact support for the element and subsequent loss thereof. Clay or resin-coated sand may be molded to an appropriate shape to provide the erodable element. Hollow metal spheres or other shapes may be used to create voids during the furnacing of the bit.

Figure 7A:
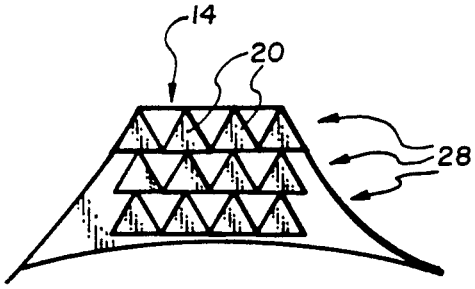
FIGS. 7A and 7B are a front elevation and a perspective view of a second preferred embodiment of the cutting structure of the present invention.
Figure 7B:
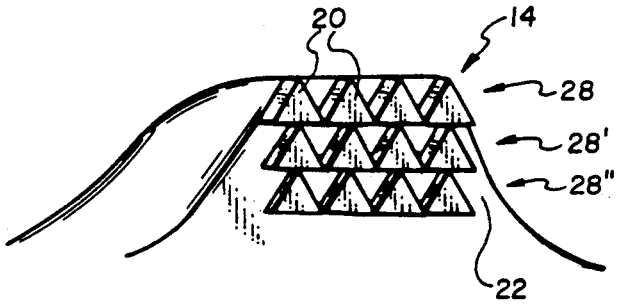

Yet another approach to controlled element renewal involves other patterns of TSP elements 20. For example, FIGS. 7A and 7B depict aligned rows of TSP elements 20, wherein each row 28 replaces the one above it as the rows wear and the elements 20 break off. The use of fracturable elements or erosion induced loss, as described with respect to FIGS. 5 and 6, may be employed with the arrangement of FIGS. 7, or, as shown in FIG. 7B, the elements 20 may protrude from the cutting face 22 so as to facilitate erosion-induced loss. In FIG. 7B, the elements 20 of uppermost row 28 are shown to protrude more than those in row 28', which in turn protrudes more from cutting face 22 than the elements 20 in lowermost row 28''. The difference in degree of protrusion facilitates sequential, row-by-row loss of elements 20.

Figure 8A:
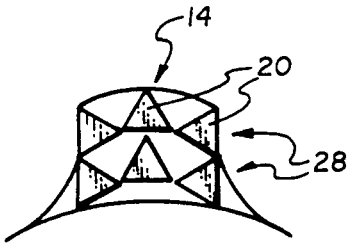
FIGS. 8A and 8B are front and side elevations of a third preferred embodiment of the cutting structure of the present invention.
Figure 8B:
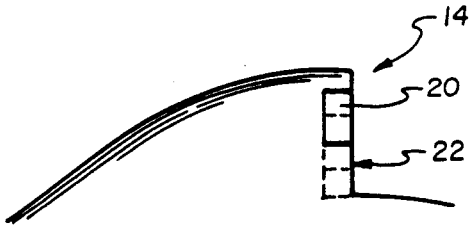

In lieu of linear rows of elements 20, arcuate rows 28, as shown in FIGS. 8A and 8B, may be utilized, particularly for smaller cutting structures 14 comprised of few elements 20.

Figure 9A:
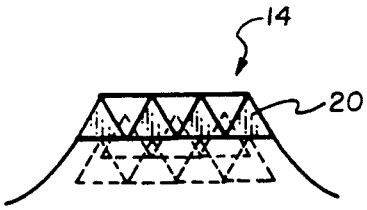
FIGS. 9A and 9B are a front elevation and a side sectional elevation of a fourth preferred embodiment of the cutting structure of the present invention.
Figure 9B:
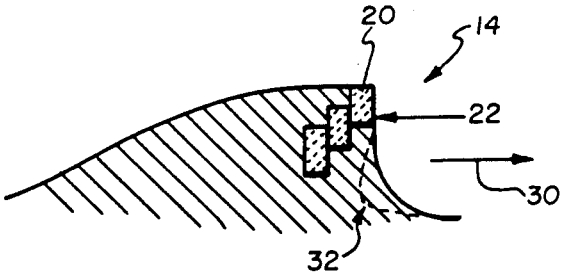
Figure 10A:
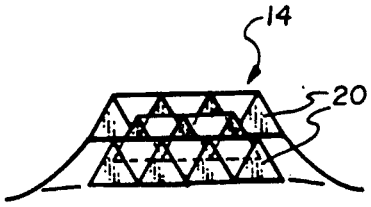
FIGS. 10A and 10B are front and side elevations of a fifth preferred embodiment of the cutting structure of the present invention.
Figure 10B:
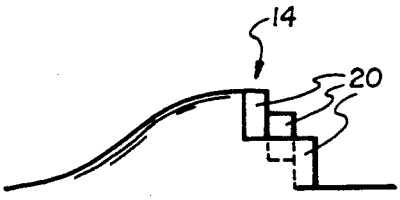

Furthermore, in lieu of substantially coplanar superimposed rows of elements, rows offset in the direction of cutter travel as depicted in FIGS. 9 and 10 may be utilized. As shown in FIGS. 9A and 9B, the uppermost row 28 is the leading row, taken in the direction 30 (arrow) of cutting, and each lower row 28 is placed therebehind in stair-step fashion. With the embodiment of FIGS. 9, the cutting face 22 may be sloped or undercut as at 32, again to facilitate controlled element loss as drilling progresses. If an ascending stair-step pattern or arrangement is used as shown in FIGS. 10A and 10B, the previously mentioned grooved element backs or erodable supports or voids behind the elements 20 may be employed to facilitate worn element removal.

Figure 11:
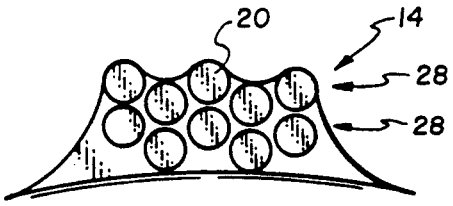
FIGS. 11, 12 and 13 are front elevations of embodiments of the cutting structure of the present invention employing alternative TSP element shapes.
Figure 12:
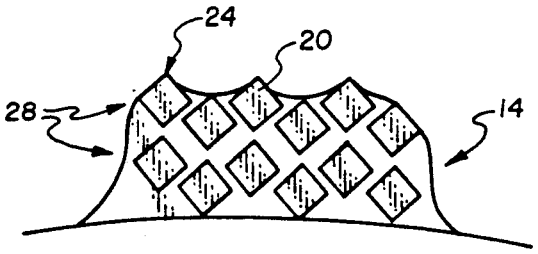
Figure 13:
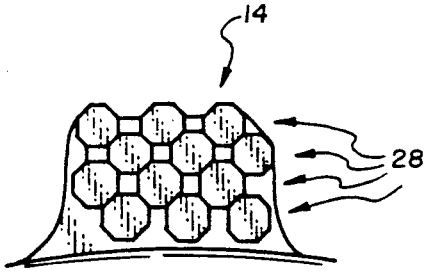

As shown by FIGS. 11–13, the present invention is not limited to triangular TSP elements. FIG. 11 illustrates the use of offset rows 28 of small TSP elements 20 in a disc shape. FIG. 12 shows rows 28 of square TSP elements 20 rotated to provide apices 24 to engage the formation. FIG. 13 illustrates the usage of small octagonal TSP elements 20 in offset rows 28. TSP elements 20 may either be closely packed in a interlocking arrangement as shown, or spaced apart. In addition, any of the TSP element shapes of FIGS. 11–13 may be employed in the arrangements shown in FIGS. 7–10, as will be evident to those of skill in the art.

Figure 14A:
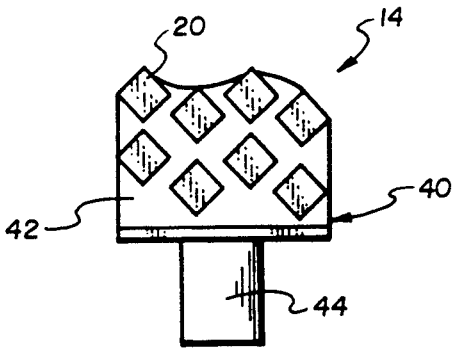
FIGS. 14A and 14B are front and side elevations of a stud-type cutting structure constructed according to the present invention.
Figure 14B:
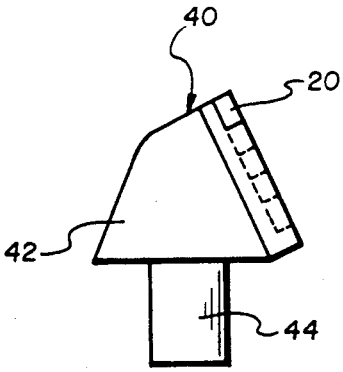

FIGS. 14A and 14B illustrate cutting structure 14 of the present invention as embodied in a stud-type carrier 40 such as might be secured to a steel body bit. Carrier 40 includes a cutting element support 42, commonly formed of tungsten carbide, with an integral stud 44 extending from the bottom. Stud 44 may be cylindrical or of other shape to facilitate cutter alignment when inserted in a hole bored in the face of a steel-body bit.

While the present invention has been described in terms of several preferred embodiments, it is not so limited, as many additions, deletions and modifications thereto are possible without departing from the spirit and scope of the claimed invention. For example, rectangular or non-equilateral triangular TSP elements might be employed in the present invention and more than one shape of TSP element may be used in an array of a cutting structure. The stair-step cutting structure disclosed in FIGS. 9 and 10 may be modified to place TSP elements of different rows directly behind or in front of each other with respect to the direction of cut. Other types of cutting elements ma be employed in lieu of or in addition to TSP elements. For example, various shapes of PDC cutters may be utilized, or natural diamonds. These and other modifications will be apparent to those of ordinary skill in the art.

I claim:

1. A rotary drag bit for penetrating a subterranean formation, comprising:

a bit shank for securing said bit to a drill string;

a bit body mounted on said bit shank and including a face for contacting said formation; and at least one cutting structure mounted on said bit face carrying a plurality of cutting elements, at least some of which include impact fracture inducement means therein, said cutting elements being disposed in an array facing in the direction of bit rotation and comprising a plurality of rows, each of said rows being located in a different substantially vertical distance from said bit face than at least one other of said rows.

2. The bit of claim 1, wherein the elements of vertically adjacent rows are laterally offset.

3. The bit of claim 2, wherein the elements of each row having another row therebelow are spaced apart and portions of the elements of each lower row protrude therebetween.

4. The bit of claim 1, wherein said rows are substantially vertically aligned.

5. The bit of claim 1, wherein said rows are offset front to back in the direction of cutting movement in stair-step fashion.

6. The bit of claim 5, wherein the uppermost row of elements from the face of the bit comprises the leading row, taken in the direction of bit rotation.

7. The bit of claim 5, wherein the uppermost row of elements from the face of the bit comprises the trailing row, taken in the direction of bit rotation.

8. The bit of claim 1, wherein at least one of said rows is nonlinear.

9. The bit of claim 8, wherein said nonlinear row is arcuate.

10. A rotary drag bit for penetrating a subterranean formation, comprising:

a bit shank for securing said bit to a drill string;

a bit body mounted on said bit shank and including a face for contacting said formation; and at least one cutting structure mounted on said bit face carrying a plurality of cutting elements disposed in an array facing in the direction of bit rotation and comprising a plurality of rows, each of said rows being located a different substantially vertical distance from said bit face than at least one other of said rows, said cutting structure including voids therein behind at least some of said cutting elements.

11. The bit of claim 10, wherein the elements of vertically adjacent rows are laterally offset.

12. The bit of claim 11, wherein the elements of each row having another row therebelow are spaced apart and portions of the elements of each lower row protrude therebetween.

13. The bit of claim 10, wherein said rows are substantially vertically aligned.

14. The bit of claim 10, wherein said rows are offset front to back in the direction of cutting movement in stair-step fashion.

15. The bit of claim 14, wherein the uppermost row of elements from the face of the bit comprises the leading row, taken in the direction of bit rotation.

16. The bit of claim 14, wherein the uppermost row of elements from the face of the bit comprises the trailing row, taken in the direction of bit rotation.

17. The bit of claim 10, wherein at least one of said rows is nonlinear.

18. The bit of claim 17, wherein said nonlinear row is arcuate.

19. A rotary drag bit for penetrating a subterranean formation, comprising:

a bit shank for securing said bit to a drill string;

a bit body mounted on said bit shank and including a face for contacting said formation; and at least one cutting structure including a substantially planar cutting face mounted on said bit face and carrying a plurality of cutting elements disposed on said cutting face in an array facing in the direction of bit rotation and comprising a plurality of rows, each of said rows being located a different substantially vertical distance from said bit face than at least one other of said rows, and at least one of said rows protruding from said cutting face in the direction of bit rotation.

20. The bit of claim 19 wherein each protruding row extends further from said cutting face than any other protruding row closer to said bit face.

21. The bit of claim 19, wherein the elements of vertically adjacent rows are laterally offset.

22. The bit of claim 21, wherein the elements of each row having another row therebelow are spaced apart and portions of the elements of each lower row protrude therebetween.

23. The bit of claim 19, wherein said rows are substantially vertically aligned.

24. The bit of claim 19, wherein said rows are offset front to back in the direction of cutting movement in stair-step fashion.

25. The bit of claim 24, wherein the uppermost row of elements from the face of the bit comprises the leading row, taken in the direction of cutting movement.

26. The bit of claim 24, wherein the uppermost row of elements from the face of the bit comprises the trailing row, taken in the direction of cutting movement.

27. The bit of claim 19, wherein at least one of said rows is nonlinear.

28. The bit of claim 27, wherein said nonlinear row is arcuate.

* * * * *